United States Patent [19]

Leibfreid

[11] 4,229,385

[45] Oct. 21, 1980

[54] VARIABLE VENTURI CARBURETOR

[76] Inventor: Russel B. Leibfreid, P.O. Box 207, Highlands, Tex. 77562

[21] Appl. No.: 44,675

[22] Filed: Jun. 1, 1979

Related U.S. Application Data

[63] Continuation of Ser. No. 863,175, Dec. 22, 1977, abandoned.

[51] Int. Cl.[3] ..... F02M 9/10

[52] U.S. Cl. ..... 261/44 H; 261/DIG. 56; 261/DIG. 59

[58] Field of Search ..... 261/DIG. 56, DIG. 58, 261/DIG. 59, 44 H

[56] References Cited

U.S. PATENT DOCUMENTS

| | | | |
|---|---|---|---|
| 977,044 | 11/1910 | Rebourg | 261/41 R |
| 1,108,128 | 8/1914 | Buffum | 261/DIG. 59 |
| 1,555,489 | 9/1925 | Spencer et al. | 261/DIG. 58 |
| 2,088,464 | 7/1937 | Chandler et al. | 261/DIG. 58 |
| 2,424,654 | 7/1947 | Gamble | 261/DIG. 56 |
| 3,456,929 | 7/1969 | Lawrence | 261/44 C |
| 3,570,824 | 3/1971 | Strohm | 261/DIG. 56 |
| 3,752,451 | 8/1973 | Kendig | 261/DIG. 58 |
| 3,896,195 | 7/1975 | Harrison | 261/DIG. 56 |
| 3,949,025 | 4/1976 | Englert et al. | 261/DIG. 56 |

FOREIGN PATENT DOCUMENTS

| | | | |
|---|---|---|---|
| 196323 | 4/1923 | United Kingdom | 261/62 |

*Primary Examiner*—Tim R. Miles
*Attorney, Agent, or Firm*—Marvin B. Eickenroht; Jennings B. Thompson

[57] ABSTRACT

A variable venturi carburetor is disclosed which has side walls that simultaneously are moved toward and away from one another to increase the size of the throat of the venturi as the engine speed increases and decrease the size of the throat as the engine speed decreases to provide a desirable constant air-to-fuel ratio to the engine over a range of engine speeds.

4 Claims, 6 Drawing Figures

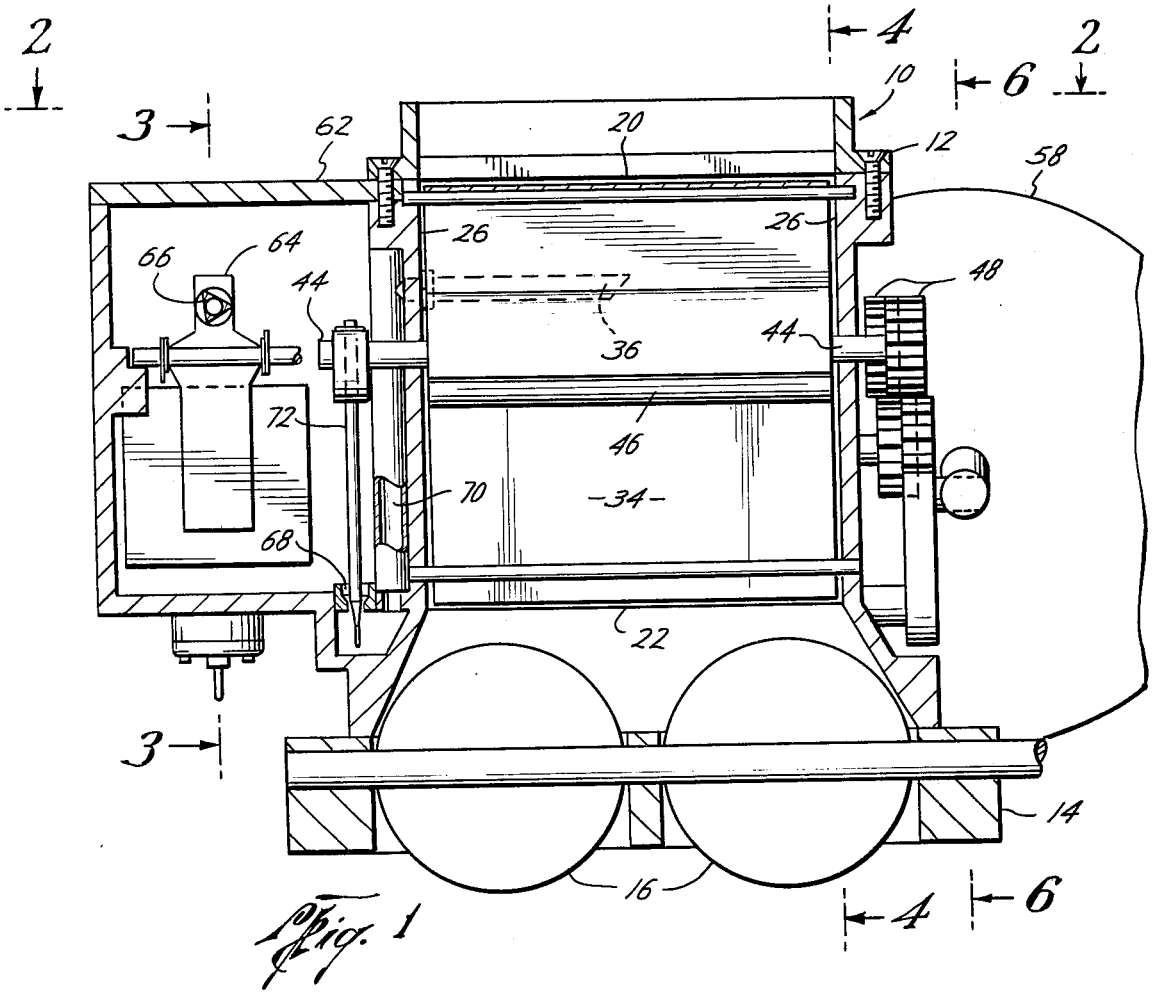
Fig. 1
Fig. 2
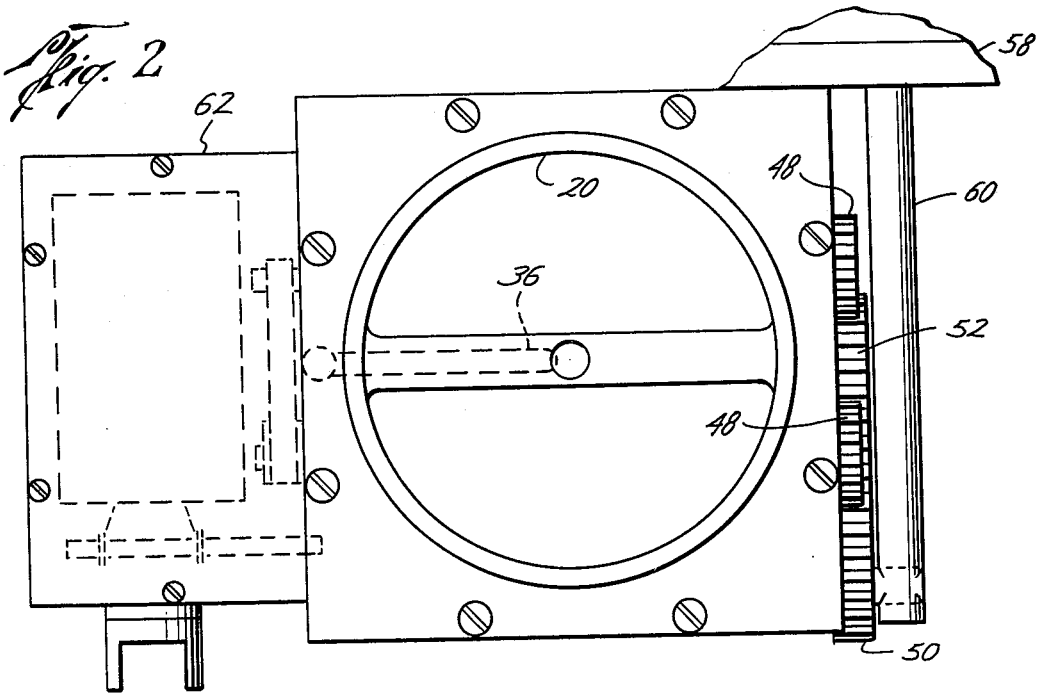

Fig. 6
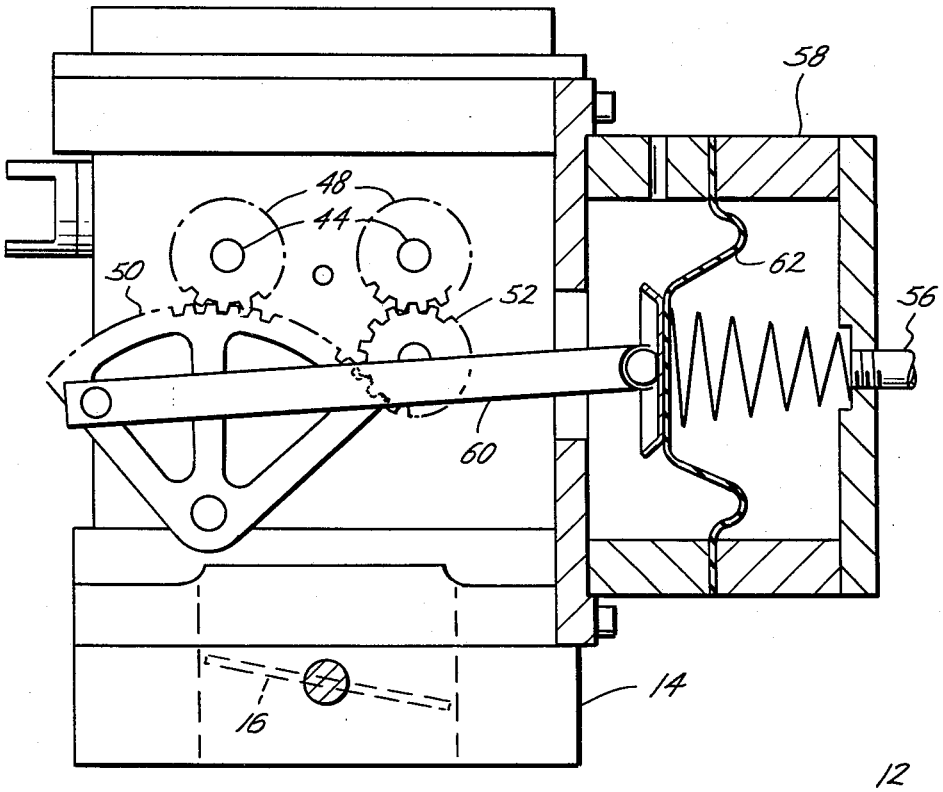
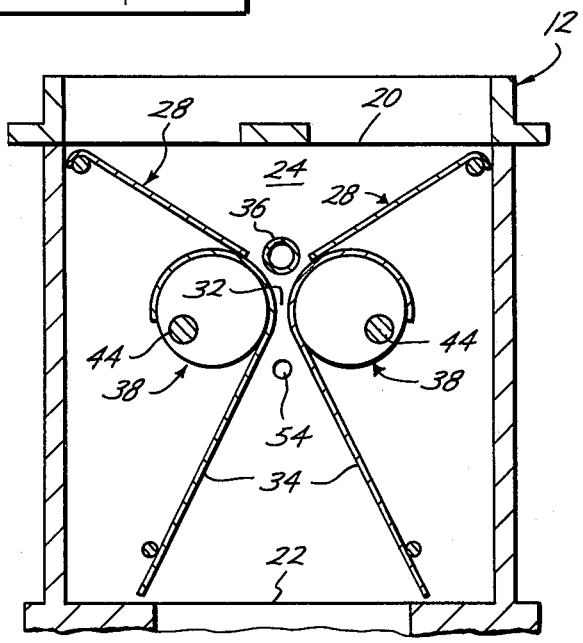
Fig. 5

VARIABLE VENTURI CARBURETOR

This is a continuation of application Ser. No. 863,175 filed Dec. 22, 1977, now abandoned.

BACKGROUND AND BRIEF SUMMARY OF THE INVENTION

This invention relates generally to carburetors and more particularly concerns a variable venturi carburetor.

Carburetors are used to atomize a liquid fuel and mix the atomized fuel with air for burning within the engine. A typical carburetor has a housing with an inlet, an outlet and a passageway connecting the inlet with the outlet. The passageway within the housing forms a venturi so that as the air passes through the venturi, a decrease in pressure occurs and the liquid fuel is withdrawn from a main nozzle disposed within the passageway just upstream of the throat of the venturi. The liquid fuel is atomized and mixed with the air as the air flow passes through the venturi. The mixture of atomized fuel and air is then carried into the engine for burning therein.

Among other variables, the degree of atomization and mixing of the fuel and air depends on the quantity of air passing through the venturi during a given time which depends on the engine speed and the throat size of the venturi. Thus, if the throat size of the venturi is fixed, there is only one engine speed where an ideal ratio of fuel-to-air occurs for any given engine. Thus, incomplete combustion of the fuel occurs at all other engine speeds for that particular engine. This incomplete combustion means that the engine is not running as efficiently as possible and pollutants are emitted from the exhaust of the engine.

A recent advance in carburetor design has been the development of a variable throat venturi within the passageway, which moves one wall relative to a fixed wall and regulates the flow of the liquid fuel into the venturi. An example of this design is disclosed in U.S. Pat. No. 3,896,195, wherein the regulation of the fuel into the venturi and the movement of the one side wall is controlled by a vacuum diaphragm operably connected to the venturi. The regulation of the fuel into the venturi takes place by a tapered valve element moveable within an opening provided in the non-moveable wall of the venturi and the valve element is mounted to the moveable wall and extends across the passageway. Thus, the change in the throat size of the venturi and the fuel flow is controlled by the drop in the vacuum, which depends on the speed of the engine.

Another recent advance in carburetor design has been the development of a variable throat venturi with both side walls of the passage being moveable relative to one another. An example of this design is disclosed in U.S. Pat. No. 3,949,025, wherein the passageway through the carburetor is defined by side walls which are pivotally mounted on the inlet side of the passageway and uses a cam member mounted on the outlet side of the passageway to move both walls together and apart simultaneously. The atomization of the fuel and movement of the air through the passageway is obtained by varying the area ratio between the throat and exit planes so that the air-to-fuel ratio is properly obtained as the engine idles.

Both of these designs have a problem in that turbulance develops as the air flows through the venturi which adversely effects atomization and mixing of the fuel. In the first design, this turbulance is created by the moveable valving element extending across the passageway. In the second design, it is believed the turbulance is created by the positioning of the pivotal axes of the side walls at the inlet and the cam at the outlet.

Further, the fuel introduced into the venturi of the latter carburetor design is not responsive to the velocity of the air passing through the venturi. This lack of regulation on the fuel flow permits the air-to-fuel ratio in this design to vary independently of the velocity of the air passing through the venturi which adversely affects the air-to-fuel ratio. If the regulation of the fuel flow was made similarly to the former design, the turbulance problem is made worst by disposing the valving element across the passageway.

An object of this invention is to provide a variable throat venturi carburetor having an aerodynamically designed passageway which eliminates the turbulance problems associated with the prior art carburetors.

Another object is to provide a variable throat venturi carburetor having side walls which simultaneously move toward and away from one another to increase the throat size as the engine speed increases and to decrease the throat size as the engine speed decreases to provide a constant air-to-fuel ratio for burning in an engine over a range of engine speeds.

Another object is to provide a variable throat venturi carburetor having side walls which are simultaneously moved toward and away from one another to increase the throat size as the engine speed increases and to decrease the throat size as the engine speed decreases and having a valving element provided in a fuel outlet leading from a fuel bowl to permit more fuel to flow as the engine speed increases and less fuel to flow as the engine speed decreases to provide a constant air-to-fuel ratio for burning in an engine over a range of engine speeds.

These and other objects are accomplished, in accordance with the invention, by a variable flow venturi carburetor which comprises a housing having an inlet, an outlet and a passageway therethrough connecting the inlet with the outlet, said passageway including generally parallel end walls and side walls having first portions which converge from the inlet to a rectangularly shaped throat intermediate the inlet and outlet and second portions which diverge from the throat to the outlet, and means for introducing fuel into the passageway upstream of the throat. In one novel aspect of this invention, wherein the first and second portions are plates, means are provided for simultaneously swinging the first and second plates about axes adjacent the inlet and outlet, respectively, so as to vary the size of the throat and means are also provided for controlling the side wall moving means in response to the speed of the engine by increasing the throat size as the engine speed increases and by decreasing the throat size as the engine speed decreases to provide a constant air-to-fuel ratio to an engine over a range of engine speeds. Another novel aspect of this invention uses means for simultaneously moving the side wall portions at the throat to vary the size of the throat and means are provided for controlling the side wall moving means in response to the speed of the engine by increasing the throat size as the engine speed increases and by decreasing the throat size as the engine speed decreases to provide a constant air-to-fuel ratio to an engine over a range of speeds. Another novel aspect of this invention, the carburetor includes a fuel bowl having an opening through which fuel is admitted, and a valving element which is shiftable between positions is provided for regulating the flow of fuel through the opening, means are provided for sensing a vacuum downstream of the throat in the passageway and means are provided responsive to the sensed vacuum for controlling a side wall moving means to increase the throat size as the engine speed increases and to decrease the throat size as the engine speed decreases and for regulating the valving element to permit more fuel to flow as the engine speed increases and less fuel to flow as the engine speed decreases to provide a constant air-to-fuel ratio to the engine over a range of engine speeds.

BRIEF DESCRIPTION OF THE DRAWINGS

Other objects and advantages of the invention will become apparent upon reading the following detailed description and upon reference to the drawings, in which like reference characters are used throughout to designate like parts:

FIG. 1 is a side elevational view, showing a preferred embodiment of a carburetor constructed according to the present invention.

FIG. 2 is a plan view, of the embodiment shown in FIG. 1 taken in the direction of arrows 2—2.

FIG. 5 is a sectional view, of the carburetor shown in FIG. 1 taken in the direction of arrows 4—4, with the throat of the venturi being in a relatively closed position occurring as the speed of the engine decreases.

FIG. 6 is an elevational view, partly in section, of the carburetor shown in FIG. 1 taken in the direction of arrows 6—6.

Figure 3:
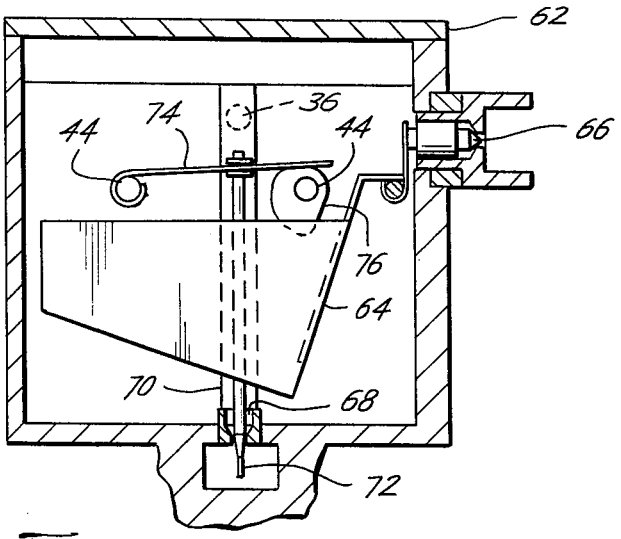
FIG. 3 is a sectional view, of the carburetor shown in FIG. 1 taken in the direction of arrows 3—3.

While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Turning now to FIG. 1, a variable venturi carburetor 10 is shown having a housing 12 positioned over a throttle valve housing 14, which is mounted to the intake manifold of an internal combustion engine (not shown). Throttle valve housing 14 is of conventional structure and supports throttle valve 16 and idle adjustment 18 therein.

Figure 4:
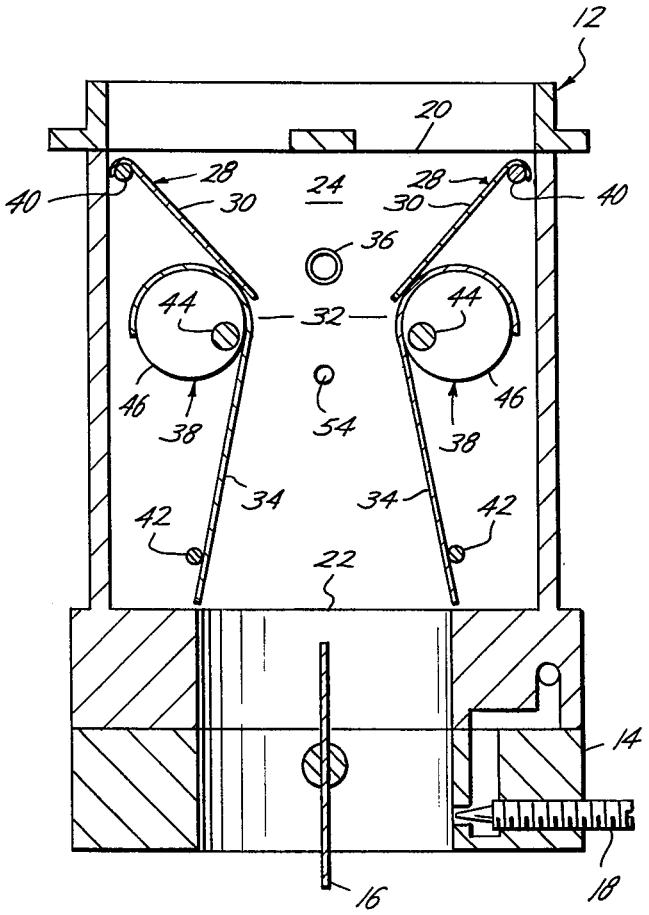
FIG. 4 is a sectional view, of the carburetor shown in FIG. 1 taken in the direction of arrows 4—4, with the throat of the venturi being in a relatively open position occurring as the engine speed increases.

As best shown in FIGS. 1, 4 and 5, housing 12 has an inlet 20, and outlet 22 and a passageway 24 therethrough connecting the inlet and the outlet. Passageway 24 includes generally parallel end walls 26 and side walls 28. Side walls 28 have first portions or plates 30 converging from inlet 20 to a rectangularly shaped throat 32 intermediate inlet 20 and outlet 22 and second portions or plates 34 which diverge from throat 32 to outlet 22.

A means 36, such as a main nozzle, is provided with carburetor 10 for introducing liquid fuel into passageway 24 just upstream of the throat. The outlet of means 36 is provided within the passageway sufficiently close to permit the liquid fuel to be withdrawn therefrom and can be readily determined by one of skilled in the art. It is preferred that means 36 have a cross-sectional configuration which is aerodynamically stable, such as a tear drop shape, so that turbulance is inhibited when such structure is positioned across passageway 24.

A means 38 is provided within housing 12 for simultaneously moving side walls 28 to vary the size of the throat. When side walls 28 are constructed from plates 30 and 34, as shown, moving means 38 will move first portions 30 about axes 40 adjacent the inlet and second portions 34 about axes 42 adjacent the outlet to thus vary the size of the throat 32.

As shown in FIGS. 1 and 4–6, the preferred structure of moving means 38 includes shafts 44 rotatably mounted in parallel side walls 26 of housing 12 for movement in opposite directions about axes generally parallel thereto. Cams 46 are mounted on shafts 44 outwardly of passageway 24 and engage side walls 28 at the junction between first portions 30 and second portions 34. This is accomplished by wrapping a portion of second plate 34 around cam 36 with first portion 30 resting thereon. This construction provides a relatively aerodynamically stable surface to air flow for inhibiting turbulance. Another construction (not shown) which may be used to provide a relatively aerodynamically stable surface is to use flaps pivotally connected to housing 12 at axes 40 and 42, wherein each flap tapers from its axes to an edge and the edges engage cams 46. The material used in the plates is selected to be inert relative to the fuel passing through carburetor 10 while being sufficiently sturdy to support the plates around the cams 46 or at axes 40 and 42, as explained. When so desired, side walls 28 may be formed by an elastomeric material (not shown) attached at inlet 20 and outlet 22, with the size of throat 32 being varied by the cams acting on such material. Gears 48 are mounted to the end of shafts 44 outwardly of housing 12 from passageway 24. A sector gear 50 is pivotally connected to housing 12 for rotating gears 48 and shafts 44 in response to a controlling means. Since shafts 44 are rotatable in opposite directions, it is necessary that an idle gear 52 be pivotallly mounted to housing 12 between one of the gears 48 and sector gear 50, as shown in FIG. 6.

As shown in FIGS. 1, 2 and 6, carburetor 10 includes a means for controlling side wall moving means 38 in response to the speed of the engine by increasing the size of throat 32 as the engine speed increases and decreasing the size of the throat as the engine speed decreases to provide a constant air-to-fuel ratio to the engine over a range of engine speeds. This is accomplished by having a port 54 (FIGS. 4 and 5) disposed within passageway 24 for sensing the pressure change therein just downstream of throat 32 and transmitting it to a vacuum diaphragm 58 through a conduit 56. The location of port 54 within passageway 24 is readily determined by one skilled in the art, but one location found to work was on a centerline between cams 46 and ⅛ inch beneath the closed apex of the cams. A control arm 60 is connected at one end to sector gear 50 and at the other end to the diaphragm 62 within vacuum diaphragm 58. Thus, as the pressure within passageway 24 changes, diaphragm 62 moves sector gear 50 and shafts 44 to cause the size of throat 32 to increase with an engine speed increase and decrease with an engine speed decrease to provide the constant air-to-fuel ratio to the given engine over a range of engine speeds.

As shown in FIGS. 1–3, carburetor 10 includes a fuel bowl 62 on one side of housing 12 for containing the liquid fuel prior to use within the given engine. Disposed within fuel bowl 62 is a float 64 to activate a valve 66 for maintaining the supply of liquid fuel within bowl 62. An opening 68 is provided in the bottom of bowl 62 through which the fuel flows to the fuel introducing means 36 by means of conventional structure, such as conduit 70. Disposed within the opening 68 is a valving element 72, which is shiftable between positions for regulating the flow fuel through opening 68. This valving element is connected to an arm 74, which has one end wrapped around one shaft 44 and another end following a cam 76, which is attached to the other shaft 44. By this arrangement, moving means 38 also regulates the flow of fuel introduced into passageway 24 by moving valving element 72. Thus, the fuel flow is regulated in response to the speed of the engine by permitting more fuel to flow through opening 68 as the engine speed increases and less fuel to flow through opening 68 as the engine speed decreases.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A variable venturi carburetor, comrpising a housing having an inlet, an outlet and a passageway therethrough connecting the inlet with the outlet, said passageway including generally parallel end walls, and side walls having first portions which converge from the inlet to a rectangularly shaped throat intermediate the inlet and outlet and second portions which diverge from the throat to the outlet, said first side wall portions being swingable about axes adjacent the inlet and said second side wall portions being swingable about axes adjacent the outlet so as to adjust the size of the throat, a pair of shafts each mounted within the ends of the housing and for rotation about an axis parallel to the axes about which the side wall portions are swingable, and extending within the housing intermediate the outer side of each side wall of the passageway, cams rotatable with the shafts in one direction to move the adjacent ends of the side wall portions toward one another to narrow the throat and in the opposite direction to permit said portions to move away from one another to widen the throat, a port in the end wall of the passageway for sensing pressure therein downstream but immediately adjacent the throat, means including a chamber having a diaphragm therein and a conduit connecting the chamber with the port so that the diaphragm reciprocates in response to the sensed pressure, means connecting the diaphragm to the ends of the shafts which extend from one end of the housing so as to rotate them in said one direction as the speed of the engine decreases and in said opposite direction as the speed of the engine increases, an elongate fuel nozzle extending parallel to the throat just upstream thereof and providing the only restriction in the passageway, a fuel bowl at the other end of the housing, a conduit connecting the fuel bowl with the nozzle, a valve element movable in the connection of the conduit to the bowl for controlling the flow of fuel from the bowl into the conduit, and means on the end of one of the shafts which extends from the other end of the housing for moving the valve element to a position to increase the flow of fuel as the speed of the engine increases and to permit the valve element to move to a position to decrease the flow of fuel as the speed of the engine decreases.

2. The carburetor set forth in claim 1, wherein the means connecting the diaphragm to the ends of the shafts includes a ring gear rotatable with each shaft, a sector gear rotatably mounted on the housing and meshing with the ring gear of one of the shafts, an idler gear meshing with the sector gear and the ring gear on the other shaft, and an arm connecting the sector gear to the diaphragm for swinging the sector gear in opposite directions in response to reciprocation of the diaphragm.

3. The carburetor of claim 1, wherein an arm is carried within the fuel bowl by the end of the other shaft which extends from the other end of the housing, a cam is rotatable with the end of said one shaft for raising and lowering the free end of the arm in response to rotation of said one shaft, and the valve element includes a vertical stem which is supported by the arm.

4. The carburetor of claim 1, wherein the second wall portions comprise plates whose ends are wrapped about a part of the cam, and the first wall portions comprise additional plates having their ends resting upon the ends of the second wall portions which are wrapped about part of the cam.

* * * * *